US007588038B2

(12) United States Patent
Jeong

(10) Patent No.: US 7,588,038 B2
(45) Date of Patent: Sep. 15, 2009

(54) SUMP ASSEMBLY FOR DISHWASHER

(75) Inventor: Mun Gyu Jeong, Busan (KR)

(73) Assignee: LG Electronics Inc., Seoul (KR)

( * ) Notice: Subject to any disclaimer, the term of this patent is extended or adjusted under 35 U.S.C. 154(b) by 687 days.

(21) Appl. No.: 11/076,528

(22) Filed: Mar. 10, 2005

(65) Prior Publication Data

US 2005/0268948 A1 Dec. 8, 2005

(30) Foreign Application Priority Data

Jun. 5, 2004 (KR) ..... 10-2004-0041109
Jun. 5, 2004 (KR) ..... 10-2004-0041110

(51) Int. Cl.
*B08B 3/00* (2006.01)

(52) U.S. Cl. ..... 134/58 D; 134/56 D; 134/57 D

(58) Field of Classification Search ..... 134/56 D, 134/57 D, 58 D
See application file for complete search history.

(56) References Cited

U.S. PATENT DOCUMENTS 5,560,060 A * 10/1996 Dausch et al. ..... 8/158
5,586,567 A * 12/1996 Smith et al. ..... 134/57 D
6,378,341 B1 * 4/2002 Wiemer et al. ..... 68/12.02
6,536,060 B1 * 3/2003 Janssens et al. ..... 8/159
2003/0019510 A1 * 1/2003 Hegeman et al. ..... 134/18
2004/0216774 A1 * 11/2004 Bertram et al. ..... 134/113
2005/0051201 A1 * 3/2005 Ashton et al. ..... 134/104.1
2006/0005863 A1 * 1/2006 Gurubatham et al. ..... 134/58 D
2006/0174923 A1 * 8/2006 Hedstrom et al. ..... 134/104.2

* cited by examiner

*Primary Examiner*—Michael Barr
*Assistant Examiner*—Jason Heckert
(74) *Attorney, Agent, or Firm*—McKenna Long & Aldridge LLP

(57) ABSTRACT

Sump assembly for a dishwasher holds washing water and supplies the washing water to spray nozzles. The sump assembly includes a sump housing for holding washing water, a pump provided to the sump housing for pumping the washing water, and a soil chamber housing for receiving a specified amount of the pumped washing water, wherein a sensor assembly is provided to the soil chamber housing for measuring a level of contamination of the received washing water.

24 Claims, 9 Drawing Sheets

SUMP ASSEMBLY FOR DISHWASHER

CROSS-REFERENCE TO RELATED APPLICATIONS

This application claims the benefit of Korean Application Nos. P2004-0041109 and P2004-0041110, both filed on Jun. 5, 2004, and are hereby incorporated by reference as if fully set forth herein.

BACKGROUND OF THE INVENTION

1. Field of the Invention

The present invention relates to dish washers, and more particularly, to a sump assembly for holding washing water and supplying the washing water to spray nozzles.

2. Discussion of the Related Art

The dish washer is a home appliance for washing dishes by spraying high pressure washing water to the dishes with spray nozzles. In general, the dish washer is provided with a tub having a washing space therein, a plurality of dish racks in the tub, spray nozzles for spraying the washing water to the dish racks, and a sump assembly for holding the washing water and supplying the washing water to the spray nozzles.

In operation of the dish washer, the washing water supplied from an outside of the dishwasher is stored in the sump assembly, and the sump assembly supplies the washing water to the spray nozzles. Then, the spray nozzles spray the washing water toward the dishes placed on the dish racks in the tub, for washing the dishes. The washing water contaminated as the dishes are washed drops down to a lower side of the tub, and stored in the sump assembly, again.

As the washing progresses, the washing water is contaminated, gradually. According to this, if the washing water is contaminated heavily, the contaminated washing water is drained from the sump assembly, and fresh washing water is supplied to the sump assembly. However, if contamination of the washing water is not heavy, the washing water is supplied from the sump assembly to the spray nozzles, again. In order to determine a level of contamination of the washing water, a sensor is provided to the sump assembly.

In general, the sensor is mounted on a bottom side of the sump assembly having the washing water held therein. However, in general, because the bottom side has sediment deposited thereon, the sensor fails to measure an accurate level of contamination due to the sediment.

In the meantime, because the sump assembly has a plurality of components assembled together, the washing water is liable to leak through joining portions of the components, or the like, to an outside of the sump assembly. If a water level of the sump assembly becomes low due to the leakage of the washing water to the outside of the sump assembly, a pump that pumps the washing water is liable to surfer from damage, or a heater that heats the washing water can be overheated. However, no dish washer has a structure for sensing the leakage of the washing water, presently.

SUMMARY OF THE INVENTION

Accordingly, the present invention is directed to a sump assembly for a dishwasher that substantially obviates one or more problems due to limitations and disadvantages of the related art.

An object of the present invention is to provide a sump assembly for a dishwasher, of which structure is improved so that a sensor can accurately measure a level of the contamination of washing water.

Another object of the present invention is to provide a sump assembly for a dishwasher in which the structure is improved for sensing leakage of washing water.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a sump assembly for a dishwasher comprises a sump housing for holding washing water, a pump provided to the sump housing for pumping the washing water, and a soil chamber housing for receiving a specified amount of the pumped washing water, wherein a sensor assembly is provided to the soil chamber housing for measuring a level of contamination of the received washing water.

The sump housing may include a recess for holding the washing water, and a sensor hole located on an upper surface outside the recess for engaging with the sensor assembly. The sump assembly further includes a soil chamber housing engaged with an upper surface of the sump housing.

The sensor assembly may include a channel for the pumped washing water to flow through, a light emitting unit for emitting a light, and a light receiving unit located on an opposite side of the channel from the light emitting unit for measuring an intensity of the light which passes through the washing water as the washing water flows through the channel. The sensor assembly may further include a ball in the channel for preventing transmission of the light between the light emitting unit and the light receiving unit when no washing water flows through the channel. The sensor assembly may further include barriers at a first channel opening and a second channel opening for preventing the ball from escaping from the channel.

Preferably, the channel may include a center portion of the channel having a lower height than heights of a first channel opening and a second channel opening, and the light receiving unit and the light emitting unit are located on an opposite side of each other in the center portion of the channel.

The sump assembly may further includes a control unit for stopping an operation of the dishwasher or generating a warning signal when the light receiving unit fails to receive the light from the light emitting unit during operation of the dishwasher.

In another aspect of the present invention, a sump assembly for a dishwasher comprises a sump housing for holding a washing water, a pump provided to the sump housing for pumping the washing water, a soil chamber housing for controlling the pumped washing water wherein a specified amount of the pumped washing water is provided to spray nozzles and rest of the washing water not provided to the spray nozzles bypasses the spray nozzles, and a sensor assembly in the soil chamber housing for measuring a level of contamination in the rest of the washing water that bypassed the spray nozzles.

The soil chamber housing may include a first guide flow passage for receiving a specified amount of the washing water and supplying the received washing water to a lower nozzle, and a second guide flow passage for receiving a specified amount of the washing water and supplying the received washing water to an upper nozzle. The soil chamber housing further includes a diverting valve at a branching portion of the first guide flow passage and the second guide flow passage for selectively guiding the specified amount of the washing water to the first guide flow passage or the second guide flow passage. The soil chamber housing includes a soil chamber for introducing the washing water that flows through the sensor assembly.

The sump assembly may further include a sump cover for engaging a bottom portion of the sump cover to an upper portion of the sump housing, enclosing the soil chamber housing between the sump cover and the sump housing. The sump cover may include a filter for filtering the washing water containing the contaminants that overflows from the soil chamber housing after passing through the sensor assembly. The sump cover may further include a plurality of apertures for allowing the washing water to pass through the filter to the sump housing.

The sump assembly may further include a drain pump for pumping out from the sump assembly the washing water held in the sump housing and from the soil chamber housing the washing water that bypassed the spray nozzle. The sump assembly may further include a disposer rotatably mounted in the sump housing for shredding contaminants in the washing.

In another aspect of the present invention, a sump housing for holding a washing water, guide flow passages for guiding a specified amount of washing water to spray nozzles, a bypass for supplying rest of the washing water not guided to the spray nozzles, a sensor assembly for measuring a level of contamination of the washing water introduced into the bypass, and a filter for filtering the washing water that passed through the sensor assembly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
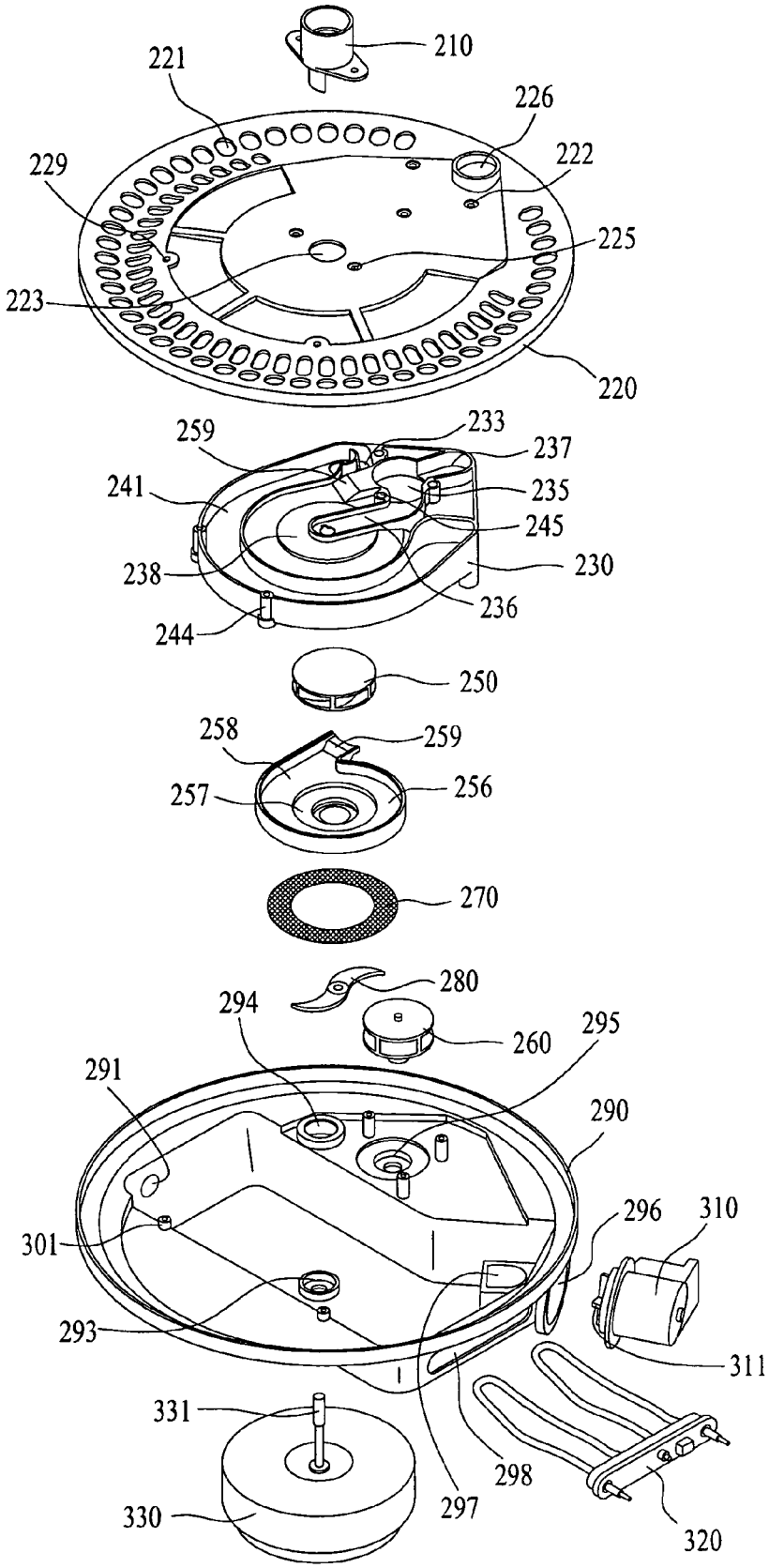
FIG. 1 illustrates a perspective exploded view of a sump assembly in accordance with a preferred embodiment of the present invention.

Referring to FIG. 1, the sump assembly for a dishwasher includes a sump housing 290 for receiving and holding washing water provided from outside the dishwasher through a water supply pipe. The sump housing 290 has a recess 292 in a center area in bottom of the sump housing 290 for holding the washing water, and a water supply hole 291 on one side of the recess 292 for connecting a water supply pipe. A heater 320 is provided for heating the washing water in the recess 292, and the recess 292 has an insertion hole 298 to insert the heater 320 in the recess 292 of the sump housing 290.

The sump housing 290 has a coupling portion 296 on one side for coupling a drain pump 310. As shown in FIG. 1, the coupling portion 296 is projected toward the recess 292, and the drain pump 310 is mounted on an outer surface of the sump housing 290 such that an impeller 311 is placed in the coupling portion 296. A first drain hole 302 is provided on one side of the coupling portion 296 in communication with the recess 292, and a second drain hole 297 is provided to an upper surface of the coupling portion 296 in communication with a soil chamber 241 which will be described later.

The first drain hole 302 has a strainer or at least one strip for preventing sediment deposited in the recess 292 from entering into the drain pump 310. The coupling portion 296 also has a nipple 299 for connecting a drain hose. Here, when the drain pump 310 is in operation, the washing water is discharged from the sump housing 290 and a soil chamber 241 to the outside through the first and second drain holes 302 and 297 and the drain hose.

A pump for pumping water from the sump housing 290 comprises a motor 330, an impeller housing 256, and an impeller 250. As shown in FIG. 1, the motor 330 is mounted on the bottom of the sump housing 290, having a shaft 331 of the motor 330 passed through the hole 293 on the bottom of the recess 292. Furthermore, as shown in FIG. 1, the shaft 331 has a disposer 280 which has a plurality of blades for smashing contaminants in the washing water when the motor 330 is operated.

Figure 3:
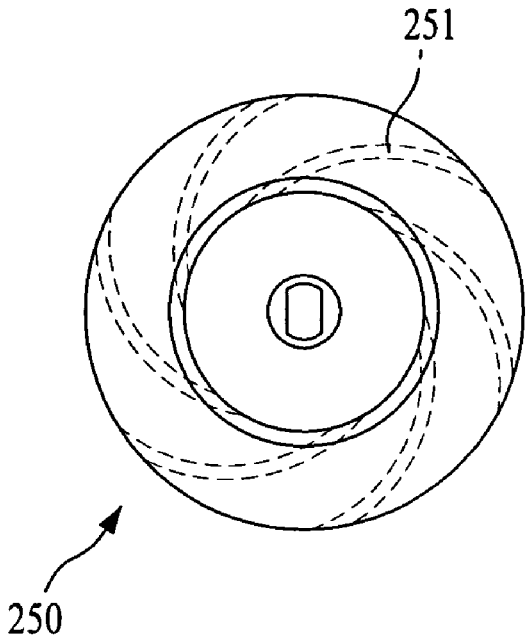
FIG. 3 illustrates a plan view of the impeller in FIG. 1.
Figure 4:
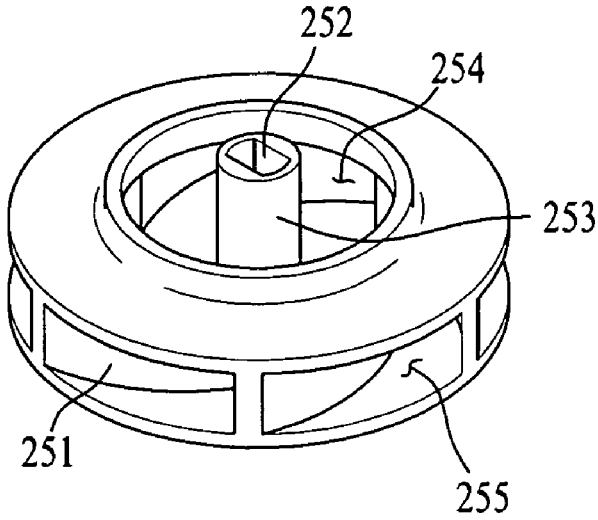
FIG. 4 illustrates a perspective view of the impeller in FIG. 1.

In addition, the shaft 331 has the impeller 250 coupled thereto. The impeller 250 draws washing water in an axial direction and discharges the washing water in a radial direction. The impeller 250 has an upper plate and a lower plate spaced from each other, and a plurality of blades 251 between the upper plate and the lower plate. The upper plate is covered, and the lower plate has an inlet 254 in the center area of the impeller 250 for insertion of the washing water. The upper plate has a hub 253 located in the center of the impeller 250. The hub 253 has an insertion hole 252 for inserting the shaft 331. As shown in FIGS. 3 and 4, there are a plurality of curved blades 251 between the upper plate and the lower plate to form an outlet for the curved blades 251 positioned adjacent to another to discharge the washing water introduced to the impeller 250 through the inlet 254.

Figure 5:
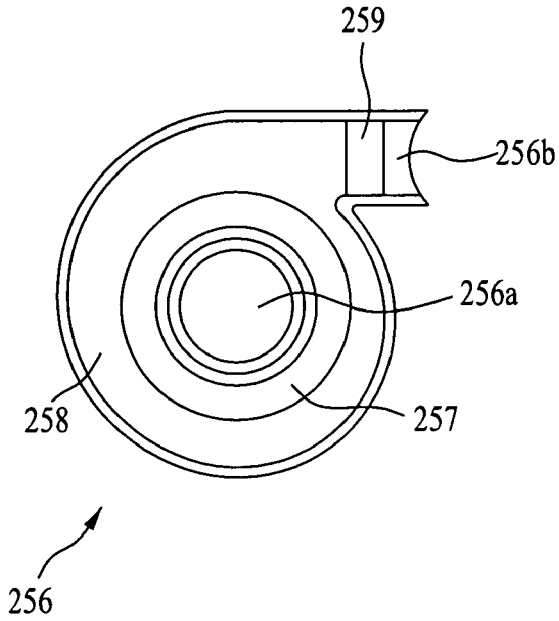
FIG. 5 illustrates a plan view of the pump housing in FIG. 1.

As shown in FIG. 1, the impeller housing 256 securely engages to a bottom side of the soil chamber housing 230 and encloses the impeller 250. As shown in FIG. 5, the impeller housing 256 has a recessed portion 257 located at the center and on the bottom of the impeller housing 256 for receiving the impeller 250 therein. The recessed portion 257 has an inlet 256*a* which has a size substantially the same as the size of the inlet 254 of the impeller 250 for receiving the washing water from the sump housing 290.

During the operation of the pump, the washing water is introduced to the impeller 250 from the sump housing 290 through the inlets 256*a* and 254. Here, as shown in FIG. 1, a strainer 270 is provided to prevent contaminants in the washing water from entering into the impeller 250 and the impeller housing 256.

A pumping flow passage 258 is provided along a circumference of the recessed portion 257. An outlet 256*b* is provided in a circumferential surface of the impeller housing 256 for making the pumping flow passage 258 in communication with the outside of the impeller housing 256. The outlet 256*b* at the end of the pumping flow passage 258 is tangential to an outside circumferential surface of the impeller housing 256. The outlet 256*b* also has a sloped surface 259 for smooth guiding of the washing water passed through the pumping flow passage 258.

Figure 6:
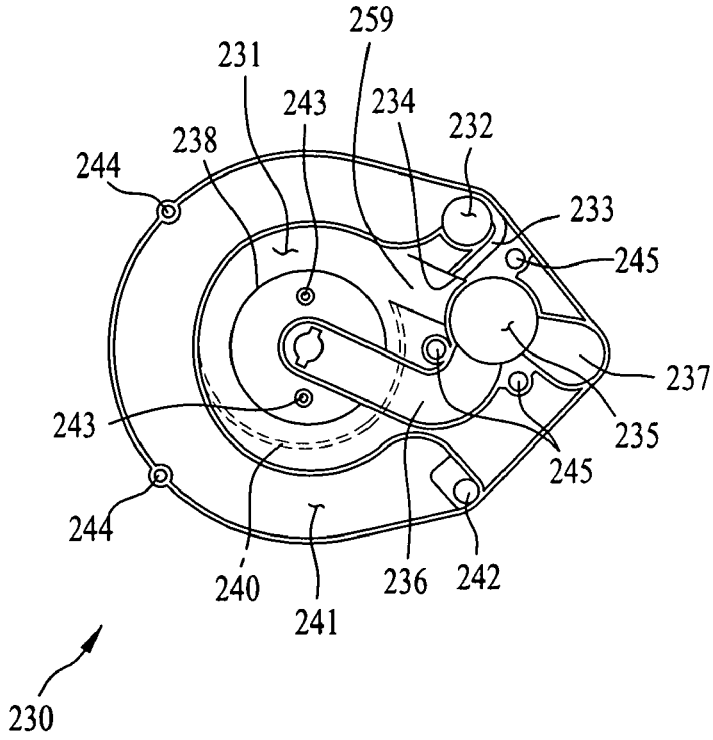
FIG. 6 illustrates a plan view of the soil chamber housing in FIG. 1.
Figure 7:
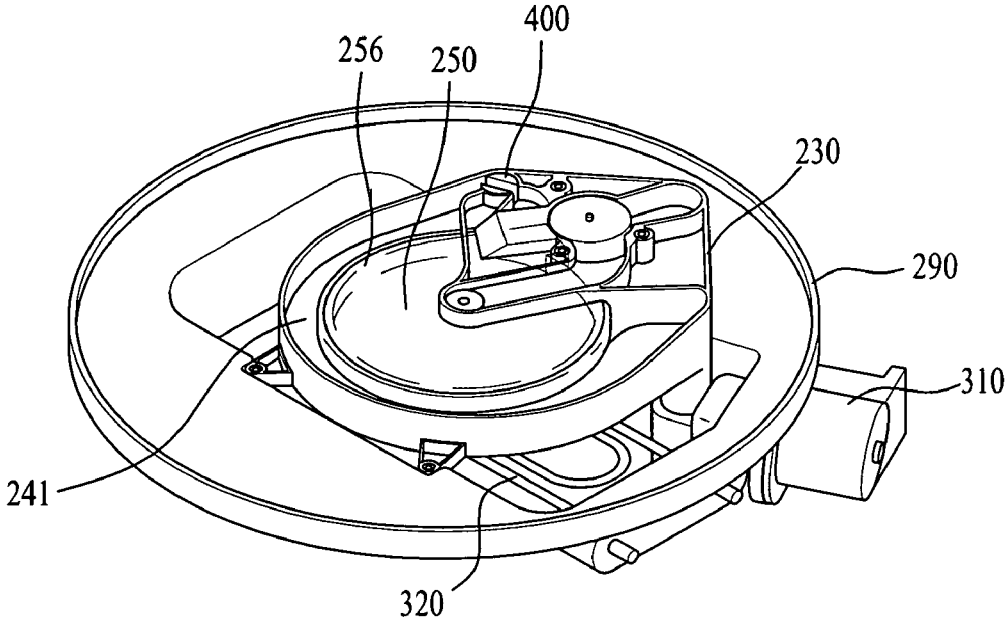
FIG. 7 illustrates a perspective view of the sump assembly in FIG. 1 having a sump cover removed therefrom.

In FIGS. 1, 6, and 7, the sump housing 290 has the soil chamber housing 230 mounted thereon. The soil chamber housing 230 receives the washing water pumped by the pump and discharged through the outlet 256*b*. The soil chamber housing 230 guides a portion of the washing water received therein to the spray nozzles of the dishwasher. The soil chamber housing 230 will be described in more detail.

The soil chamber housing 230 has a valve receiving portion in communication with the outlet 256*b*. The valve receiving portion 235 has a first guiding flow passage for supplying the washing water to a lower nozzle of the dishwasher, and a second guiding flow passage 237 for supplying the washing water to an upper nozzle which are connected. The first guiding flow passage 236 extends from the valve receiving portion 235 to a center of the soil chamber housing 230, and the second guiding flow passage 237 extends from the valve receiving portion 235 to an edge of the soil chamber housing 230. The first guiding flow passage 236 and the second guiding flow passage 237 are connected to pipes which are connected to the lower nozzle and the upper nozzle, respectively.

Figure 2:
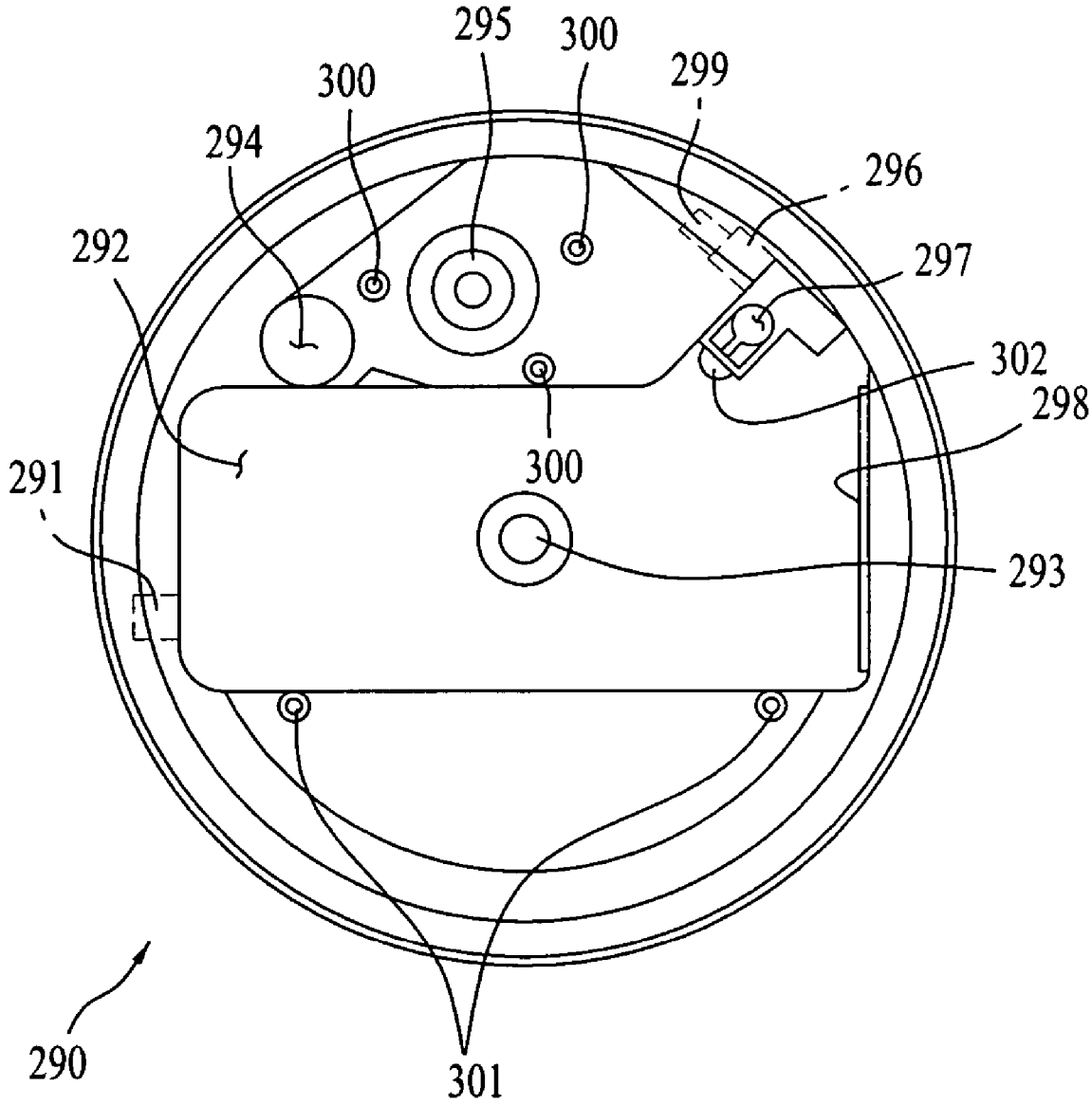
FIG. 2 illustrates a plan view of the sump housing in FIG. 1.

The valve receiving portion 235 receives a diverting valve 260 for selectively guiding a portion of the washing water from the outlet 256*b* either to the first guiding flow passage 236 or to the second guiding flow passage 237. The diverting valve 260 is rotated by a motor (not shown) mounted under the sump housing 290. Furthermore, as shown in FIGS. 1 and 2, the sump housing 290 has a hole for connecting a shaft of the motor with the diverting valve 260 and a recessed portion 295 around the hole for receiving a lower end of the diverting valve 260.

On a lower side of the soil chamber housing 230, a housing receiving portion 240 is provided to engage with an upper edge of the impeller housing 256. Furthermore, an impeller receiving portion 238 for receiving an upper portion of the impeller 250 to enclose the impeller 250 together with the impeller housing 256 is provided. The housing receiving portion 240 is, for example, a rib projected to a height from a bottom side of the soil chamber housing 230. Accordingly, a space between an outside circumferential surface of the housing receiving portion 240 and an outside circumferential surface of the impeller receiving portion 238 becomes the pumping flow passage 231. At the end of the pumping flow passage 231, there are the outlet 256*b* and the sloped surface 259 as described above.

As shown in FIGS. 1 and 6, a hole 234 is located on a side of the sloped surface 259 with a bypass 233 connected thereto. Furthermore, a sensor receiving portion 232 is located at the end of the bypass 233 and at one of the ends of the soil chamber 241. As shown in FIGS. 6 and 7, the soil chamber 241 extends along a circumference of the soil chamber housing 230. A drain 242 is also provided at the other end of the soil chamber 241, connected to the second drain hole 297 in the sump housing 290 shown in FIGS. 1 and 2.

Accordingly, a specified amount of the washing water pumped by the pump is introduced into the valve receiving portion 235 through the outlet 256*b* and supplied to the upper nozzle or the lower nozzle by the diverting valve 260. The rest of the pumped washing water is introduced into the soil chamber 241 through the bypass 233 connected to the sloped surface 259. During the pump operation and with the washing water in the sump housing 290 at a regular level, the washing water flows at a fixed rate to the soil chamber 241 through the bypass 233.

A sensor assembly 400 for measuring the level of contamination in the washing water is provided to the sensor receiving portion 232 located between the bypass 233 and the soil chamber 241. Since the level of contamination of the washing water is measured from the washing water flowing at a fixed rate, the sensor assembly 400 can more accurately measure the level of contamination than those of related arts whose contamination measurements are inaccurately taken with sediments and the like in the washing water. The sensor assembly 400 will be described with reference to FIGS. 1 and 8 to 10B.

Referring to FIG. 1, the sump housing 290 has a sensor hole 294 for the sensor assembly 400 to pass through. The sensor assembly 400 is mounted such that an upper end of the sensor receiving portion 232 is positioned at the sensor receiving portion 232 after the sensor assembly 400 passes through the sump housing 290 and the soil chamber housing 230.

Figure 8:
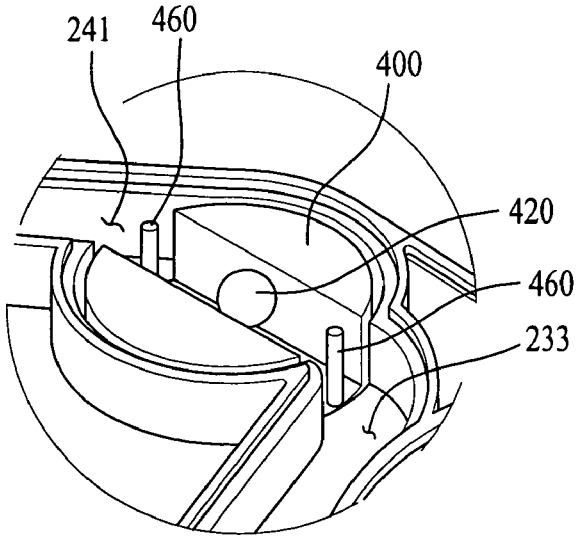
FIG. 8 illustrates an enlarged perspective view showing detail of the sensor assembly mounted on the sump assembly in FIG. 7.
Figure 9:
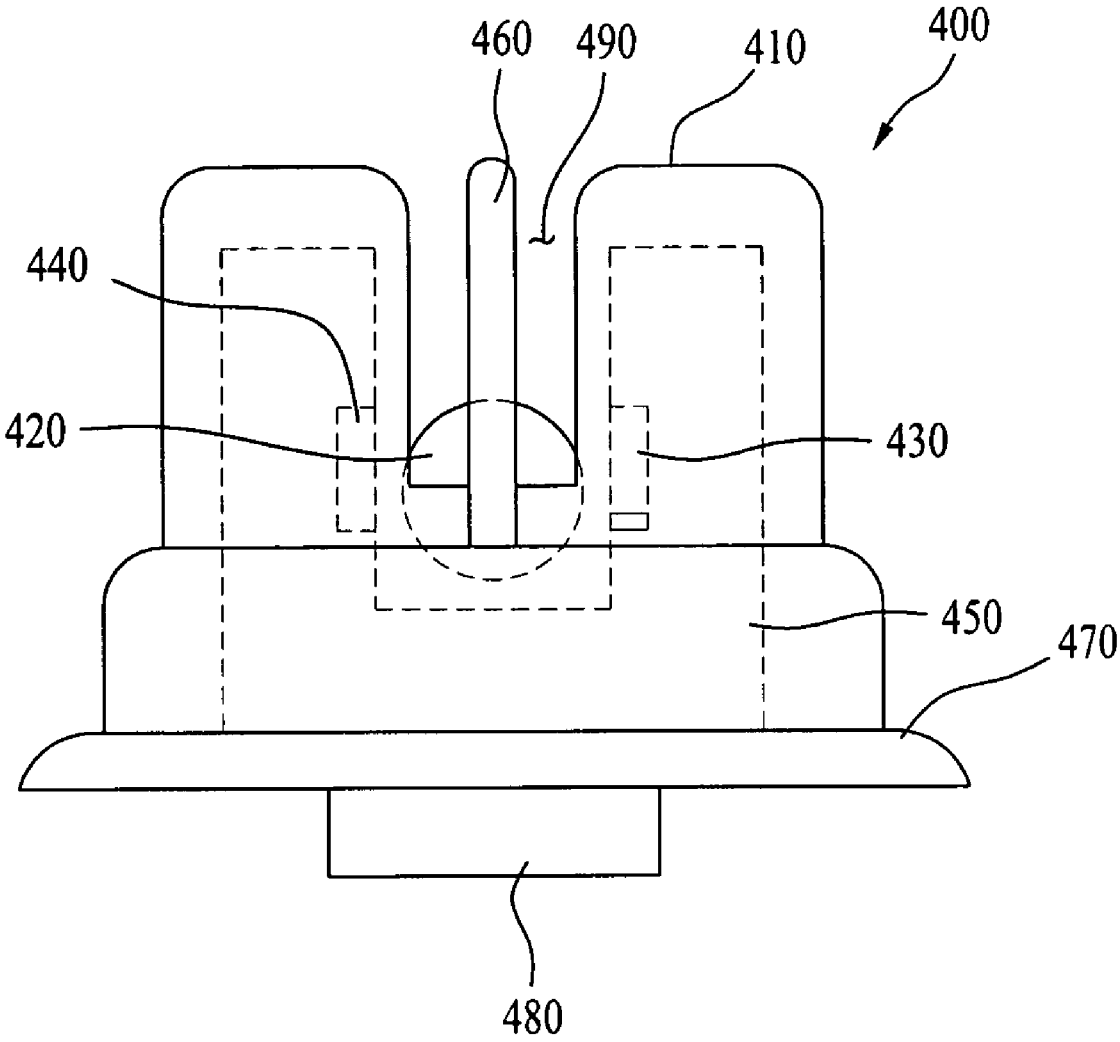
FIG. 9 illustrates a front view of the sensor assembly in FIG. 8.

Referring to FIGS. 8 and 9, the sensor assembly 400 has a channel 490 in a middle of an upper portion of the case 410 in communication with the bypass 233 and the soil chamber 241. Therefore, the washing water is introduced from the bypass 233 to the soil chamber 241 after passing through the channel 490.

Referring to FIG. 9, in the case 410 of the sensor assembly 400, a circuit board 450, having a light emitting unit 430 and a light receiving unit 440, is provided. The light emitting unit 430 and the light receiving unit 440 are arranged opposite to each other with reference to the channel 490. Therefore, a light emitted from the light emitting unit 430 passes through the washing water in the channel 490 and reaches to the light receiving unit 440 on the opposite side of the channel 490. Here, the sensor assembly 400 can determine the level of contamination of the washing water by an intensity of the light received in the light receiving unit 440. Furthermore, a seal 470 under the case 410 for preventing leakage through the sensor hole 294 is provided, and a terminal 480 on a bottom side of the case 410 connected to the circuit board 450 is provided.

Referring to FIG. 8, the channel 490 has a ball 420 and barriers 460 located at an inlet and an outlet of the channel 490 for preventing the ball 420 from escaping from the channel 490.

Figure 10A:
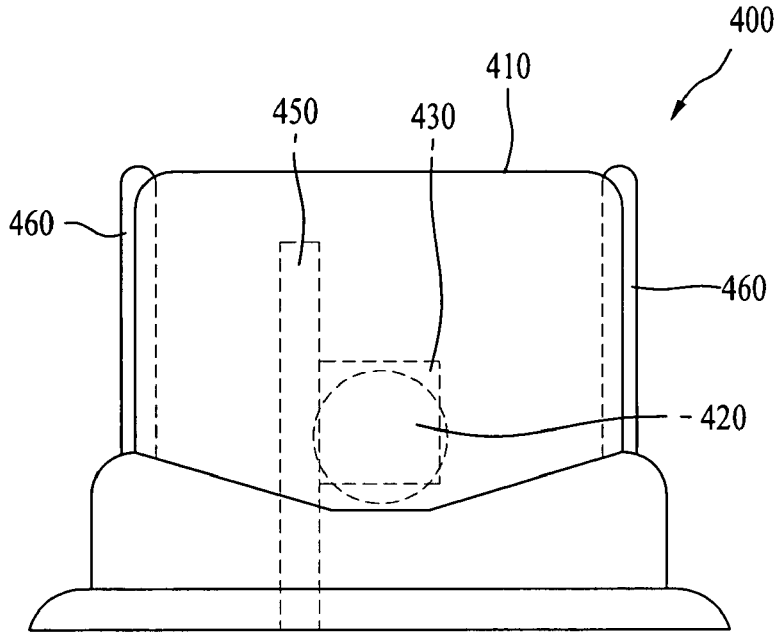
FIGS. 10A and 10B illustrate side views showing operation of the sensor assembly in FIG. 8.
Figure 10B:
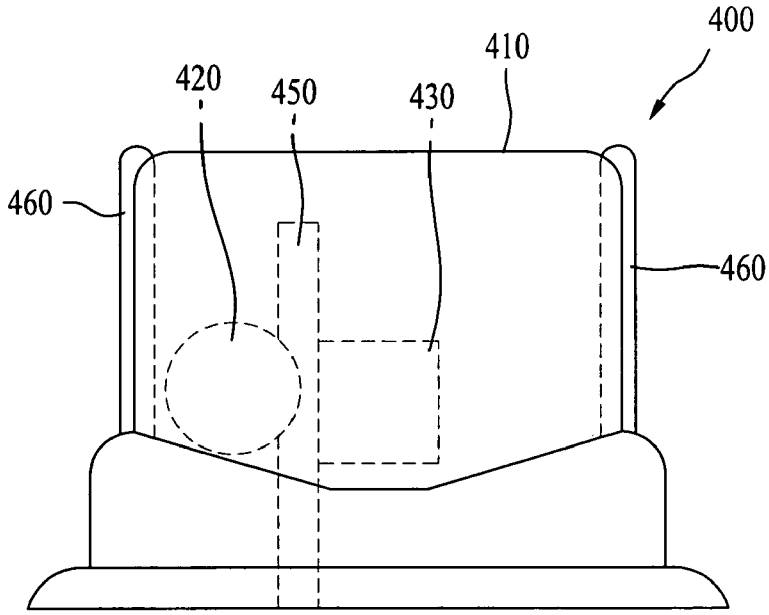

As shown in FIGS. 10A and 10B, the channel 490 has a bottom surface of the channel having a low middle portion and high inlet and outlet portions. In the channel 490, the passage on which the ball 420 travels has inclining slopes from the middle portion of the passage to the inlet and the outlet, respectively.

Furthermore, as shown in FIG. 10A, when the washing water is not introduced to pass through the channel 490, the ball 420 rests in the middle portion of the channel 490. The position of the ball 420 in the middle portion of the channel 490 prevents the light from being received by the light receiving unit 440 since the ball in positioned between the light emitted unit 430 and the light receiving unit 440.

As shown in FIG. 10A, if the light receiving unit 440 cannot receive the light emitted from the light emitting unit 430 during the dishwashing operation, the washing water does not circulate due to various reasons such as inoperative pump or shortage of the washing water in the sump housing 290. In such a case, a control unit of the dishwasher provides a warning signal, such as an alarm or a flashing signal, for the user to check for possible problems (e.g., malfunctioning pump or a leakage in the sump housing). Additionally, overheating of the heater 320, which may lead to possible electrical shortage or even fire, can be prevented by turning off power and stopping operation of the dishwasher.

On the other hand, if there is an adequate amount of washing water in the sump housing 290, the washing water passes through the channel 490 when the pump is in operation. As shown in FIG. 10B, the ball 420 in the channel 490 is pushed by the washing water to the outlet side, clearing the passage in the middle portion of the channel 490, thus enabling the light receiving unit 440 to receive the light from the light emitting unit 430.

Here, the control unit determines the level of contamination of the washing water based on the intensity of the light received at the light receiving unit 440. The control unit further determines, a washing time period, a washing number of times, a rinsing time period, a rinsing number of times, and so on. For an example, if the light reached at the light receiving unit 440 is very weak, which suggests that the washing water is heavily contaminated, the control unit increases the washing number of times by at least one time or the rinsing number of times by at least one time.

Figure 11:
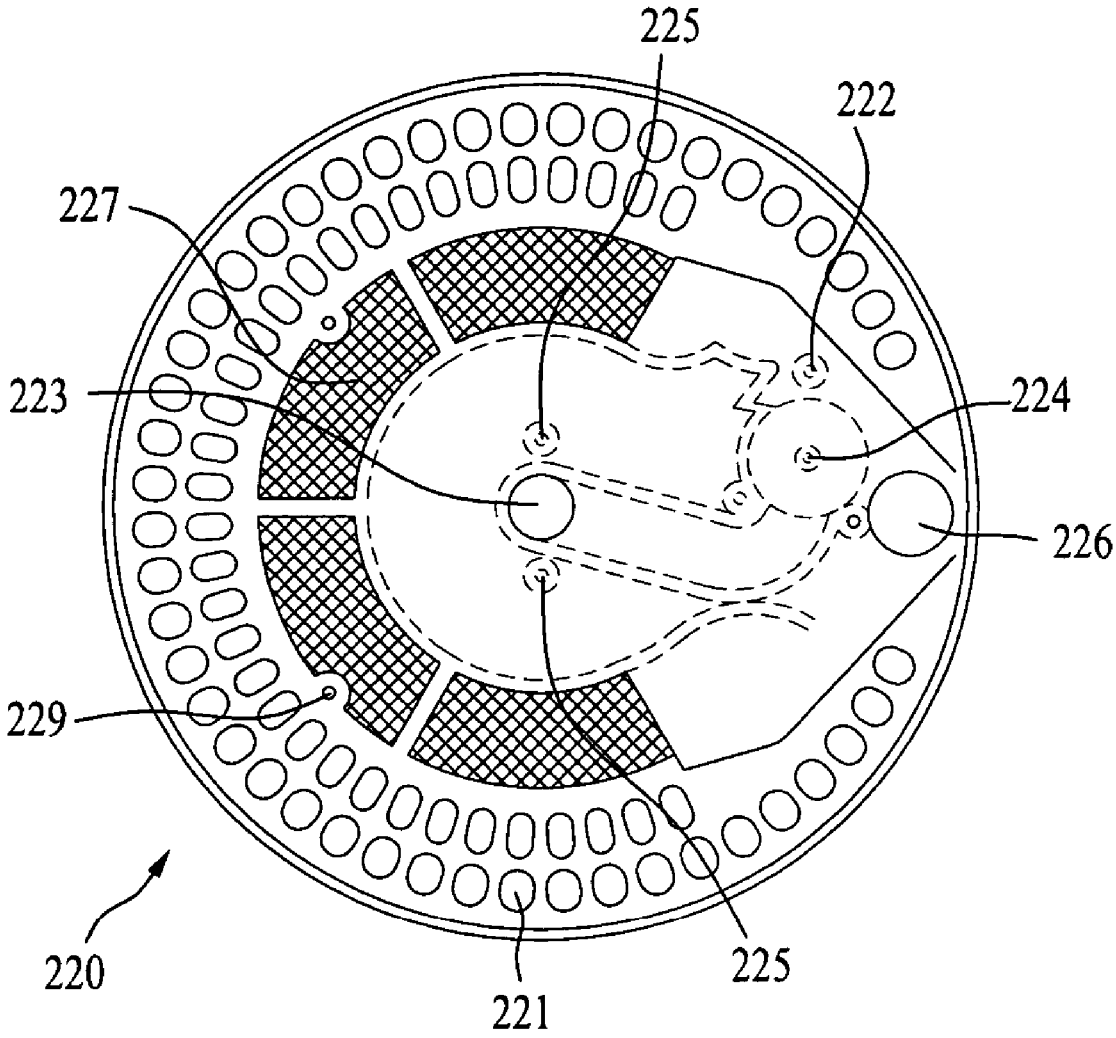
FIG. 11 illustrates a plan view of the sump cover in FIG. 1.

As shown in FIG. 1, a sump cover 220 covering an opened top of the sump housing 290 is provided. The sump cover 220 is, for example, shaped like a disc with a plurality of openings in a center portion and a plurality of apertures 221 on an outer circumference of the sump cover 220. The plurality of openings in the center portion is covered with a mesh-shaped filter 227 as shown in FIG. 11. The openings occupied with the filter 227 are positioned on top of the soil chamber 241 to cover the soil chamber 241. Furthermore, the plurality of apertures 221 receives the washing water passed through the filter from the tub of the dishwasher. In other words, the washing water passes through the filter from the bottom. The washing water then allows the filtered washing water to pass through the apertures 221 to the sump housing 290.

Referring to FIG. 11, on a bottom surface of the sump cover 220, a pocket 224 is provided for holding an upper end of the diverting valve 260. A first communication hole 223 is provided at the center of the sump cover 220 for connecting the lower nozzle and the first guide flow passage 236. Furthermore, a second communication hole 226 is provided on an end of the sump cover 220 for connecting the upper nozzle and the second guide flow passage 237.

Referring to FIG. 1, a connector 210 is provided to the first communication hole 223 for connecting the pipe connected to the lower nozzle and the first guide flow passage 236.

Figure 12:
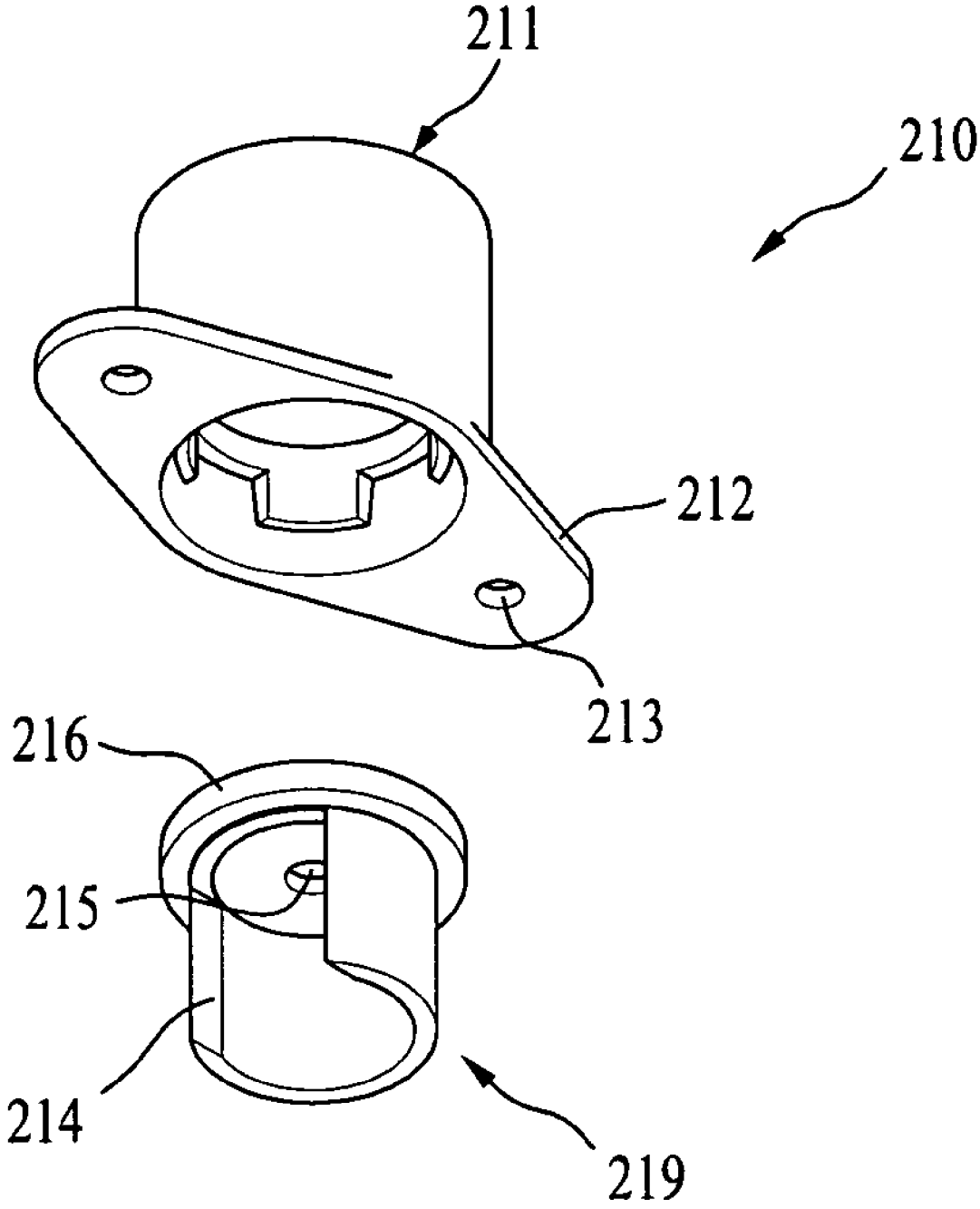
FIG. 12 illustrates a perspective exploded view of a connector for connecting a pipe connected to a spray nozzle to the sump assembly in FIG. 1.

In FIG. 12, the connector 210 includes an upper piece 211 and a lower piece 219. The lower piece 219 is cylindrical in shape and is designed to engage with the first communication hole 223 of the sump cover 220 and insert in the first guide flow passage 236 of the soil chamber housing 230. On a side of the lower piece 219, there is an opening 214 for connecting the first guide flow passage 236 and a passage of an inside of the lower piece 219. Furthermore, there is an outlet 215 on a top of the lower piece 219 for discharging the washing water introduced into the lower piece 219 through the openings 214 to an upper side of the lower piece 219. Also in FIG. 12, there is a flange 216 on the top portion of the lower piece 219. When the lower piece 219 is engaged with the first communication hole 223, the flange 216 is positioned against the sump cover 220 and inserted in a lower portion of the upper piece 211.

The upper piece 211 is, for example, cylindrical in shape for inserting the top of the lower piece 219, more particularly, having the flange 216 of the lower piece 219 inserted therein. The upper piece 211 has a flange 212 with holes 213 for fastening members, such as screws. Moreover, holes 225 corresponding to the holes 213 are provided in the vicinity of the first communication hole 223 of the sump cover 220. Accordingly, the connector 210 can securely be fastened to the sump cover 220 with the fastening members.

The upper piece 211 of FIG. 12 has an open top for connection to the pipe connected to the lower nozzle. Therefore, the washing water introduced into the first guide flow passage 236 is supplied to the lower nozzle through the connector 210 and the pipe. The second communication hole 226 at the edge of the sump cover 220 is connected to the pipe connected to the upper nozzle. Therefore, the washing water introduced into the second guide flow passage 237 is supplied to the upper nozzle through the pipe.

As shown in FIGS. 1 and 2, the sump housing 290 has a plurality of bosses 300 and 301. In addition, as shown in FIGS. 1 and 6, the soil chamber housing 230 has a plurality of bosses 245 and 244 corresponding to the bosses 300 and 301. Furthermore, as shown in FIGS. 1 and 11, the sump cover 220 is provided with holes 222 and 229 corresponding to the bosses 245 and 244. Accordingly, the sump housing 290, the soil chamber housing 230, and the sump cover 220 are securely engaged with fastening members (e.g., bolts).

The operation of the sump assembly of the present invention will be described. When the dishwasher starts washing or rinsing, fresh water is introduced into the recess 292 in the sump housing 290 through the water supply hole 291 connected to the water supply pipe. The washing water introduced into the recess 292 is heated at the heater 320. After fresh water is supplied, the motor 330 of the pump begins its operation, pumping up the washing water from the recess 292.

Then, a specified amount of the washing water is introduced into the valve receiving portion 235 through the outlet 256*b*, and guided either to the first guide passage 236 or the second guide flow passage 237 by the diverting valve 260. The washing water from the first guide flow passage 236 is supplied to the lower nozzle through the connector 210, and the washing water from the second guide flow passage 237 is provided to the upper nozzle through the second communication hole 226. The washing water supplied to the lower nozzle washes the dishes on the lower rack in the tub of the dishwasher, and the washing water supplied to the upper nozzle washes the dishes on the upper rack in the tub of the dishwasher.

After the dishwashing operation is completed, the washing water used for dishwashing, along with contaminants such as food residue, fall to the bottom of the tub. Then, the contaminants and the washing water are introduced into the sump housing 290 through the apertures 221 of the sump cover 220 and are held in the recess 292. As previously described, the washing water returned to the recess 292 after the dishwashing operation can contain much contaminants. The contaminants are then shredded and made into small pieces by the disposer 280 driven by the motor 330. Thereafter, the washing water containing the shredded contaminants is pumped by the pump.

The washing water containing the shredded contaminants pumped up by the pump is introduced to the bypass 233 through the hole 234 by impeller 250 of the pump. Then, the washing water is introduced from the bypass 233 to the soil chamber 241 via the channel 490 of the sensor assembly 400. In this instance, as described above, the level of contamination of the washing water passing through the channel 490 is accurately measured by the sensor assembly 400. Furthermore, the control unit automatically controls the washing time period, the washing number of times, the rinsing time period, and the rinsing number of times, to name a few, based on the level of contamination of the washing water measured by the sensor assembly 400.

The washing water that passed through the channel 490 of the sensor assembly 400 and introduced into the soil chamber 241 is supplied to the drain pump 310 through the drain 242. However, because the drain pump 310 is not in operation, the washing water does not exit to the outside through the drain hose. Furthermore, the washing water containing the contaminants introduced to the soil chamber 241 remain in the soil chamber 241.

With passage of time, a water level of the soil chamber 241 increases, such that the washing water introduced into the soil chamber 241 can overflow. When the washing water overflows, the overflowing washing water passes through the filter 227 and the apertures 221 in the sump housing 290, and then returned to the sump housing 290. However, of the contaminants introduced into the soil chamber 241, large pieces are filtered at the filter 227 and accumulated in the soil chamber 227.

As described before, the washing water introduced into the soil chamber 227 via the bypass 233 is filtered by the filter 227 and supplied to the sump housing 290. The filtered washing water supplied to the sump housing 290 passes through above steps again, and supplied to the spray nozzles. Thus, the sump assembly of the present invention supplies the washing water to the nozzles while filtering the washing water during washing or rinsing.

In a case when the washing or rinsing time period is completed or the washing water is heavily contaminated, the drain pump 310 begins operation. The washing water and contaminants in the soil chamber 241 and the recess 292 of the sump housing 290 are discharged to the outside of the dishwasher via the drain hose by the drain pump 310.

As previously described, in the sump assembly of the present invention, the sensor assembly 400 is mounted in the soil chamber housing 230 over the recess 292 of the sump housing 290 and inspects the washing water supplied thereto at a fixed rate pumped by the pump. Therefore, the sensor assembly 400 of the present invention can measure the level of contamination of the washing water accurately more than that of the related art, which had a sensor mounted on the bottom of the recess 292.

As described before, if the washing water leaks from the sump assembly, the ball 420 of the sensor assembly 400 cuts off transmission of the light to the light receiving unit 440. Then, the control unit generates a warning signal and cuts off power to the heater 320. Subsequently, since the user can check for problems such as malfunctioning pump or a leakage from the sump assembly, the user can become aware of the status of the dishwasher easily and quickly. Furthermore, generating a warning signal or cutting off power can prevent in advance the dishwasher from being out of order or even causing fire by the overheating heater.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A sump assembly for a dishwasher, comprising:

a sump housing having a recess, that is formed at a bottom of the sump housing and holds a washing water;

a pump provided in the recess of the sump housing and pumping the washing water held in the sump housing;

a soil chamber housing disposed in the sump housing to be adjacent to the recess of the sump housing and controlling the pumped washing water, wherein a specified amount of the pumped washing water is provided to spray nozzles and the rest of the washing water not provided to the spray nozzles bypasses the spray nozzles; and a sensor assembly disposed in the soil chamber housing and measuring a level of contamination in the rest of the washing water that bypassed the spray nozzles.

2. The sump assembly as claimed in claim 1, wherein the sensor assembly comprises:

a channel for allowing the washing water that bypassed the spray nozzles to flow through, and a light emitting unit and a light receiving unit located on an opposite side of the channel from each other for measuring a level of contamination of the washing water by measuring an intensity of the light which passes through the washing water as the washing water passes through the channel.

3. The sump assembly as claimed in claim 1, wherein the sensor assembly further includes a ball in a channel, wherein the ball is positioned between a light emitting unit and a light receiving unit in a center portion when no washing water flows through the channel, and a height of the center portion of the channel is lower than heights of a first channel opening and a second channel opening.

4. The sump assembly as claimed in claim 1, wherein the soil chamber housing includes:

a first guide flow passage for receiving a specified amount of the washing water and supplying the received washing water to a lower nozzle, and a second guide flow passage for receiving a specified amount of the washing water and supplying the received washing water to an upper nozzle.

5. The sump assembly as claimed in claim 4, wherein the soil chamber housing further includes a diverting valve at a branching portion of the first guide flow passage and the second guide flow passage for selectively guiding the specified amount of the washing water to the first guide flow passage or the second guide flow passage.

6. The sump assembly as claimed in claim 1, wherein the soil chamber housing includes a soil chamber for introducing the washing water that flows through the sensor assembly.

7. The sump assembly as claimed in claim 1, further comprising a sump cover for engaging a bottom portion of the sump cover to an upper portion of the sump housing, enclosing the soil chamber housing between the sump cover and the sump housing.

8. The sump assembly as claimed in claim 7, wherein the sump cover includes a plurality of apertures for allowing the washing water containing the contaminants to pass through to the sump housing after a dishwashing operation.

9. The sump assembly as claimed in claim 7, wherein the sump cover includes a filter for filtering the washing water containing the contaminants that overflows from the soil chamber housing after passing through the sensor assembly.

10. The sump assembly as claimed in claim 9, wherein the sump cover further includes a plurality of apertures for allowing the washing water to pass through the filter to the sump housing.

11. The sump assembly as claimed in claim 1, further comprises a drain pump for pumping out from the sump assembly the washing water held in the sump housing and from the soil chamber housing the washing water that bypassed the spray nozzle.

12. The sump assembly as claimed in claim 1, further comprising a disposer rotatably mounted in the sump housing for shredding contaminants in the washing.

13. The sump assembly as claimed in claim 1, wherein the soil chamber housing includes:

guide flow passages guiding a specified amount of the pumped washing water to the spray nozzles, a bypass guiding the rest of the pumped washing water not provided to the spray nozzles to the sensor assembly, and a soil chamber directly communicating with the sensor assembly, and storing contaminants of the washing water introduced to the soil chamber from the sensor assembly.

14. The sump assembly as claimed in claim 13, wherein a sump cover includes a filter provided above the soil chamber for filtering the washing water overflowing from the soil chamber, and a plurality of apertures for allowing the filtered washing water to pass through to the sump housing.

15. A sump assembly for a dishwasher, comprising:

a sump housing having a recess, that is formed at a bottom of the sump housing and holds a washing water;

a pump disposed in the recess of the sump housing and pumping the washing water held in the sump housing;

guide flow passages disposed in the sump housing and guiding a specified amount of the washing water to spray nozzles;

a bypass disposed in the sump housing and provided with the rest of the washing water not guided to the spray nozzles;

a sensor assembly disposed in the sump housing and measuring a level of contamination of the washing water introduced into the bypass;

a soil chamber disposed in the sump housing and directly connected to the sensor assembly, wherein the soil chamber stores contaminants of the washing water introduced to the soil chamber from the sensor assembly; and a filter provided at an upper portion of the sump housing to cover the soil chamber and the recess of the sump housing and filtering the washing water in the soil chamber such that the filtered contaminants are held in the soil chamber.

16. The sump assembly as claimed in claim 15, wherein the sensor assembly comprises:

a channel for allowing the washing water to flow through that passed through the bypass, a light receiving unit and a light emitting unit located on opposite sides of the channel from each other, and a ball in the channel for preventing transmission of light from the light emitting unit to the light receiving unit when no washing water flows through the channel.

17. The sump assembly as claimed in claim 16, further comprising a control unit for stopping operation of the dishwasher or generating a warning signal when the light receiving unit fails to receive the light rom the light emitting unit during washing or rinsing.

18. The sump assembly as claimed in claim 15, further comprising a sump cover which includes a plurality of apertures for allowing the washing water to pass through to the sump housing after washing the dishes and allowing a filtered washing water to pass through to the sump housing.

19. The sump assembly as claimed in claim 1, wherein the soil chamber housing is disposed adjacent to the pump.

20. The sump assembly as claimed in claim 1, wherein the sensor assembly further includes a ball in the channel for preventing transmission of the light between the light emitting unit and the light receiving unit when no washing water flows through the channel.

21. The sump assembly as claimed in claim 15, wherein the bypass, the sensor assembly, and the soil chamber are disposed adjacent to the recess of the sump housing.

22. The sump assembly as claimed in claim 15, wherein the bypass, the sensor assembly, and the soil chamber are disposed adjacent to the pump.

23. The sump assembly as claimed in claim 15, wherein the sensor assembly further includes a ball in the channel for preventing transmission of the light between the light emitting unit and the light receiving unit when no washing water flows through the channel.

24. The sump assembly as claimed in claim 15, wherein the sensor assembly further includes barriers at a first channel opening and a second channel opening for preventing the ball from escaping from the channel.

* * * * *